US005603272A

United States Patent [19]

Takahashi et al.

[11] Patent Number: 5,603,272

[45] Date of Patent: Feb. 18, 1997

[54] TWO-NEEDLE TYPE SEWING MACHINE

[75] Inventors: Yoshimi Takahashi; Yasushi Kakizaki, both of Tokyo, Japan

[73] Assignee: Juki Corporation, Tokyo, Japan

[21] Appl. No.: 487,099

[22] Filed: Jun. 7, 1995

Related U.S. Application Data

[63] Continuation-in-part of Ser. No. 451,770, May 26, 1995, abandoned.

[30] Foreign Application Priority Data

May 27, 1994 [JP] Japan ..... 6-115658
Jan. 26, 1995 [JP] Japan ..... 7-010738

[51] Int. Cl.[6] ..... D05B 1/08; D05B 65/00

[52] U.S. Cl. ..... 112/163; 112/300

[58] Field of Search ..... 112/300, 163, 112/165, 166, 167, 470.01, 470.05, 470.36

[56] References Cited

U.S. PATENT DOCUMENTS 3,582,663 6/1971 Troast, Jr. ..... 112/300 X 4,421,045 12/1983 Portilla ..... 112/300 X

*Primary Examiner*—Peter Nerbun

*Attorney, Agent, or Firm*—Morgan, Lewis and Bockius LLP

[57] ABSTRACT

A two-needle sewing machine includes first and second sewing needles for performing two stitching operations at the same time; a motor for driving the first and second sewing needles; first and second thread cutting mechanisms provided for the first and second sewing needles, respectively, for cutting threads at the ends of the stitching operations; a first actuator and a second actuator for driving respective ones of the first and second thread cutting mechanisms; and a thread cutting control circuit which stores data corresponding to the timing of a first thread cutting drive signal to the first actuator and the timing of a second thread cutting drive signal to the second actuator, both signals corresponding to rotational speeds of the motor, and which, according to the data and the rotational speeds of the motor, applies the first and second thread cutting drive signals to the first and second actuators at different times defined by the data.

9 Claims, 13 Drawing Sheets

TWO-NEEDLE TYPE SEWING MACHINE

This is a continuation-in-part of application Ser. No. 08/451,770, filed May 26, 1995, now abandoned.

BACKGROUND OF THE INVENTION

1. Field of the Invention

This invention relates to a two-needle sewing machine which performs two stitching operations with two sewing needles at the same time, and more particularly to a two-needle sewing machine in which each of the sewing needles is provided with a thread cutting mechanism.

2. Related Art

FIG. 11 shows a two-needle sewing machine 1. The sewing machine 1 comprises: a sewing machine body 3 mounted on the upper surface of an operating stand 2; a motor 4 and a sewing machine control device 5 which are mounted below the operating stand 2; and an operating pedal 6 set near the floor. When the operating pedal 6 is stepped on, the motor 4 is driven under control of the sewing machine control device 5. The rotation of the motor 4 is transmitted through an endless belt to a sewing machine pulley 8 which is fixedly mounted on the spindle of the sewing machine body 3. The torque of the spindle rotating together with the pulley 8 is transmitted through a cam machine to a cloth feeding mechanism and a needle driving mechanism in the sewing machine body 3, so that two stitching operations are carried out with two needles 9A and 9B in a parallel mode (at the same time) while a material such as a fabric to be sewn is being fed.

The sewing machine body 3 includes a table section 3*a*, in which, as shown in FIG. 12, a pair of thread cutting mechanisms 11A and 11B are provided below the sewing needles 9A and 9B, respectively. A lock-stitching shuttle race (not shown) is provided below each of the thread cutting mechanism 11A and 11B. The thread cutting mechanism 11A has a stationary knife 12A and a movable knife 13A. Similarly, the thread cutting mechanism 11B has a stationary knife 12B and a movable knife 13B. The stationary knives 12A and 12B are secured horizontal from stationary parts 15 of the sewing machine body 3, respectively, while the movable knives 13A and 13B are coupled to the upper end portions of rotary shafts 16, respectively, in such a manner that they are horizontally swingable. In order to drive the thread cutting mechanisms 11A and 11B, cylinders 14A and 14B are provided, as thread cutting actuators, below the thread cutting mechanisms 11A and 11B. In the cylinders 14A and 14B, cylinder bodies 17A and 17B are fixed in the sewing machine body 3 in such a manner that they are extended horizontally, and the end portions of cylinder rods 18A and 18B are coupled through hinge mechanisms 19A and 19B to the lower ends of the rotary shafts 16, respectively. With the thread cutting mechanisms, thread cutting operations are carried out as follows: The cylinders 14A and 14B are driven to swing the movable knives 13A and 13B, so that the threads are positioned in place with the end portions of the movable knives 13A and 13B, and then the threads thus positioned are cut with the movable knives 13A and 13B in cooperation with the stationary knives 12A and 12B.

FIG. 13 is a block diagram showing a control system provided for a conventional two-needle sewing machine, and FIG. 14 is a time chart showing the timing of the driving of the thread cutting actuators (i.e., the cylinders 14A and 14B).

In FIG. 13, reference numeral 7 designates a thread cutting control circuit provided in the sewing machine control device 5. The circuit 7 comprises: a central processing unit (CPU) 20; and a pedal sensor 21, a cycle origin detector 22, a needle position detector 23 and a motor speed detector 24 which are connected to the input section of the CPU 20; and a motor driver circuit 25 and a thread cutting drive 26 which are connected to the output section of the CPU 20. The CPU 20 applies a motor drive instruction signal to the motor driver circuit according to detection signals from the pedal sensor 21 and the detectors 22 through 24 and to data stored in its memory, to rotate the motor 4 at a predetermined speed, and increases the number of stitches by one whenever the needle position detector 23 detects the needle upper end. When the number of stitches reaches a predetermined value corresponding to one sewing cycle, the CPU 20 applies a motor stop instruction signal to the motor driver circuit 25. In addition, upon detection of a needle up signal a predetermined number of stitches (for instance one stitch) before the sewing needles 9A and 9B are stopped, the CPU 20 applies a thread cutting instruction signal to the thread cutting driver circuit 26.

In response to the thread cutting instruction signal, the thread cutting driver circuit 26 applies thread cutting drive signals S to the two thread cutting cylinders 14A and 14B at the same time, thereby causing the latter 14A and 14B to perform the thread cutting operations.

The above-described operations are repeatedly carried out to repeatedly perform the stitching operation of one and the same pattern.

The above-described stitching operation is carried out for instance in the case where belt loops are sewed to trousers one after another. In this case, both end portions of a belt loop are sewed with the two sewing needles 9A and 9B at the same time. That is, a stitching operation of a pattern corresponding to a sewing cycle from the start to the end of the sewing operation, is carried out for each belt loop.

The above-described conventional thread cutting control circuit 7 is designed so that the two thread cutting cylinders 14A and 14B are driven by the one thread cutting driver circuit 26. Hence, the two thread cutting drive signals S1 and S2 output by the thread cutting driver circuit 26 are turned on and off with the same timing. This feature provides the following difficulty: In the case where thread cutting cylinders (14A and 14B having different response times (t1 and t2) from each other must be employed because of the mechanical space of the sewing machine body 3, or in the case where, although the thread cutting cylinders have equal performances, they become different in response time (t1 and t2) because of a difference in mechanical load between the thread cutting mechanisms 11A and 11B, the two thread cutting cylinders 14A and 14B are started at different time instants. That is, it is impossible to start the two thread cutting mechanisms 11A and 11B at the same time.

In the case of FIG. 14, one of the thread cutting mechanisms, namely, the thread cutting mechanism 11A, starts the thread positioning operation in the response time t1 after the thread cutting drive signal S1 is raised to an "on" level, and starts the thread cutting operation in the response time t3 after the thread cutting drive signal S1 is set to an "off" level. However, the other thread cutting mechanism 11B starts the thread positioning operation in the response time t2 ($t1<t2$) after the thread cutting drive signal S2 is raised to an "on" level, and starts the thread cutting operation in the response time t4 after the thread cutting drive signal is set to an "off" level. That is, the thread cutting operation by the other thread cutting mechanism 11B is not started until the lapse of the period of time (t2–t1) after the one thread cutting mechanism 11A starts the thread cutting operation.

In FIGS. 14 and 15, reference character b designates the range of speeds of the spindle in which the thread positioning operation can be stably achieved with respect to the operations of the sewing needles 9A and 9B. Where the thread positioning operation is achieved with the speed of the spindle in the range b, as in the case of FIG. 14, the two thread cutting mechanism 11A and 11B can start the thread cutting operations correctly. However, if the sewing machine which is going to be stopped has a high speed, the thread positioning operation of the thread cutting mechanism 11B, which has a slower "on" response (or which, when the thread cutting drive signal is raised to "on" level, responds later), may not be achieved within the range b as shown in FIG. 15. This fact increases the probability of a failure in cutting of the thread, and adversely affecting the stitching operation.

Hence, the two-needle sewing machine 1 must be operated at sufficiently low speed for the response of the thread cutting cylinder which has a slower "on" response (namely, the thread cutting cylinder 14B) to achieve a speed within the range b with which the thread positioning operation can be stably achieved. Therefore, it is not permitted to operate the sewing machine at high speed until just before the sewing machine is stopped. Hence, in the case where a repeated stitching operation is performed, the sewing cycle time cannot be shorten, which makes it difficult to improve the sewing efficiency.

SUMMARY OF THE INVENTION

Accordingly, an object of the invention is to eliminate the above-described difficulties accompanying a conventional two-needle sewing machine. More specifically, an object of the invention is to provide a two-needle sewing machine which, even in the case where thread cutting actuators having different response characteristics are employed, is operated independently of the response time of the actuator which is slower in response, and in which the two thread cutting mechanism achieve the thread cutting operations stably at all times.

In order to achieve the object, the present invention provides a two-needle sewing machine comprising: first and second sewing needles for performing two stitching operations at the same time; a motor for driving the first and second sewing needles; first and second thread cutting mechanisms provided for the first and second sewing needles, respectively, for cutting threads at the ends of the stitching operations; a first actuator and a second actuator for driving respective ones of the first and second thread cutting mechanisms; and a thread cutting control circuit which stores data corresponding to the timing of a first thread cutting drive signal to the first actuator and the timing of a second thread cutting drive signal to the second actuator, both signals corresponding to rotational speeds of the motor, and which, according to the data and the rotational speeds of the motor, applies the first and second thread cutting drive signals to the first and second actuators at different times defined by the data.

Preferably, in the thread cutting control circuit, the timing of the application of the thread cutting drive signal to the first actuator and the timing of the application of the thread cutting drive signal to the second actuator are stored as data corresponding to the numbers of stitches and the needle positions which are reached after the start of a stitching operation for every range of speed of the motor, and the data thus stored are utilized to obtain the number of stitches and the needle position corresponding to the speed of rotation of the motor for each of the actuators; and when the number of stitches and the needle position which are obtained after the start of the stitching operation reach those which are obtained from the data, the thread cutting drive signal is applied to the respective actuator.

Also, according to the present invention, as a second embodiment thereof, there is provided a two-needle sewing machine comprising: first and second needles performing two stitching operations at the same time; a motor for driving the first and second sewing needles; first and second thread cutting mechanisms provided for the first and second sewing needles, respectively, for cutting threads at the ends of the stitching operations; a first actuator and a second actuator for driving respective one of the first and second thread cutting mechanisms; and a thread cutting control circuit which stores therein a timing for application of the thread cutting drive signal to the first actuator as data corresponding to the rotational speeds of the motor or the present sewing machine, finds a timing for application of the thread cutting drive signal to the first actuator in accordance with the thus stored data and the rotational speeds of the motor or the present sewing machine, calculates a time to apply the thread cutting drive signal to the second actuator according to the response difference between the first and second actuators, and applies the thread cutting drive signals to the associated actuators at their respective timings.

The thread cutting control circuit applies the thread cutting drive signals to the first and second actuators at different times according to the data which have been stored therein with respect to the application time of the thread cutting drive signals, and to the speed of rotation of the motor. Hence, even in the case where the actuators are different in response, suitable data are stored in the thread cutting control circuit in advance so that the thread cutting drive signal is applied to one of the actuators earlier which is slower in response than the other, whereby the two actuators are driven with the same timing. That is, the sewing machine can be operated without being limited by the response time of the actuator having a slower response. In addition, since the two thread cutting mechanisms can be driven with the same timing, the thread cutting operation can be stably achieved at all times.

In the thread cutting control circuit, the timing of application of the thread cutting drive signal to the first actuator and the timing of application of the thread cutting drive signal to the second actuator are stored as data corresponding to the numbers of stitches and the needle positions which are formed after the start of a stitching operation for any range of motor speed, and with the number of stitches and the needle position obtained from the data for each actuator as triggering data, the thread cutting drive signal is applied to the respective actuator. Hence, the timing of the driving of the two actuators different in response is accurately controlled, so that the two thread cutting mechanisms can be driven with the same timing.

Also, the thread cutting control circuit, which is used in the second embodiment of a two-needle sewing machine according to the invention, applies the thread cutting drive signal to one actuator at a timing in accordance with its own stored data on the timings of the thread cutting drive signals and the rotational speeds of the motor or the present sewing machine, and also applies the thread cutting drive signal to the other actuator at a timing found by means of calculation according to the response difference between the two actuators.

Thereafter, even with use of two actuators differing in the response characteristics from each other, if proper data on the driving timings of one of the two actuators are previously stored in the thread cutting control circuit, then the control circuit is able to apply the thread cutting drive signal earlier to the actuator having a slower response characteristic to thereby make the driving timings of the two actuators to coincide with each other, so that the sewing machine can be operated at an arbitrary speed without being restricted by the response time of the actuator having a slower response characteristic. In the second embodiment as well, since the two thread cutting mechanisms can be always driven at the same timing, the thread cutting operation can be performed stably.

DETAILED DESCRIPTION OF THE PREFERRED EMBODIMENTS

Figure 11:
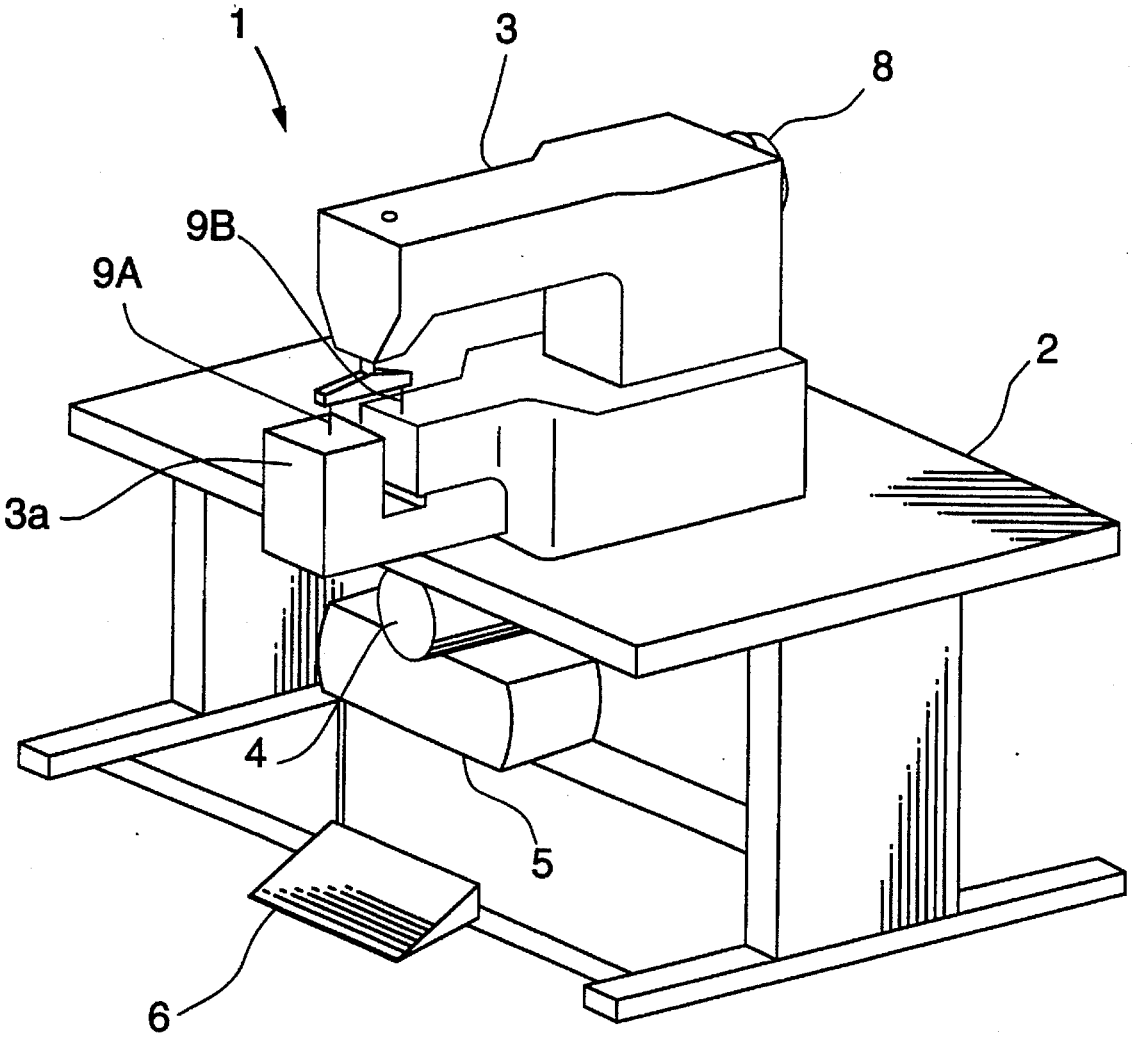
FIG. 11 is a perspective view of a two-needle sewing machine.
Figure 12:
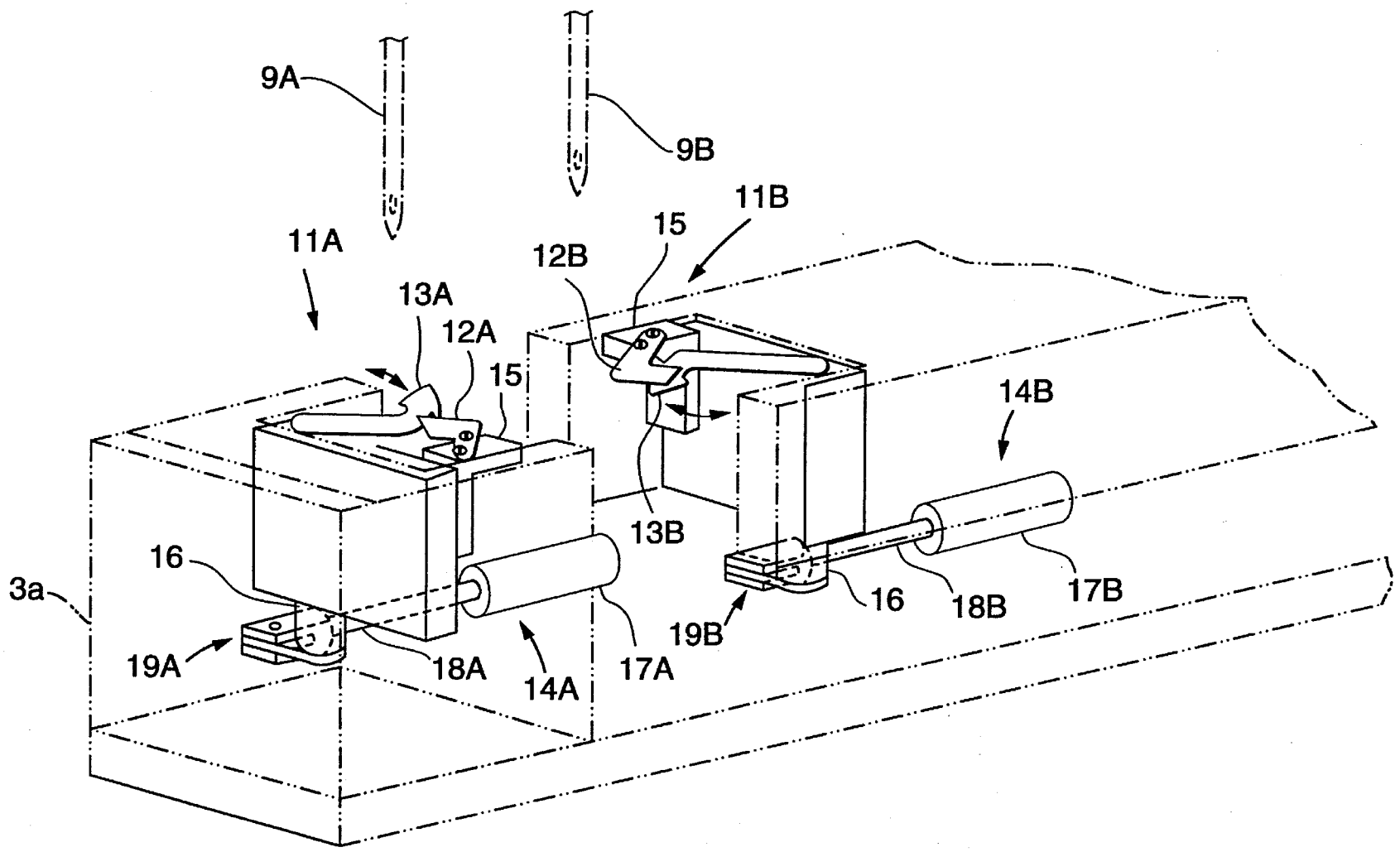
FIG. 12 is a perspective view of a thread cutting mechanism provided in the two-needle sewing machine shown in FIG. 11.
Figure 13:
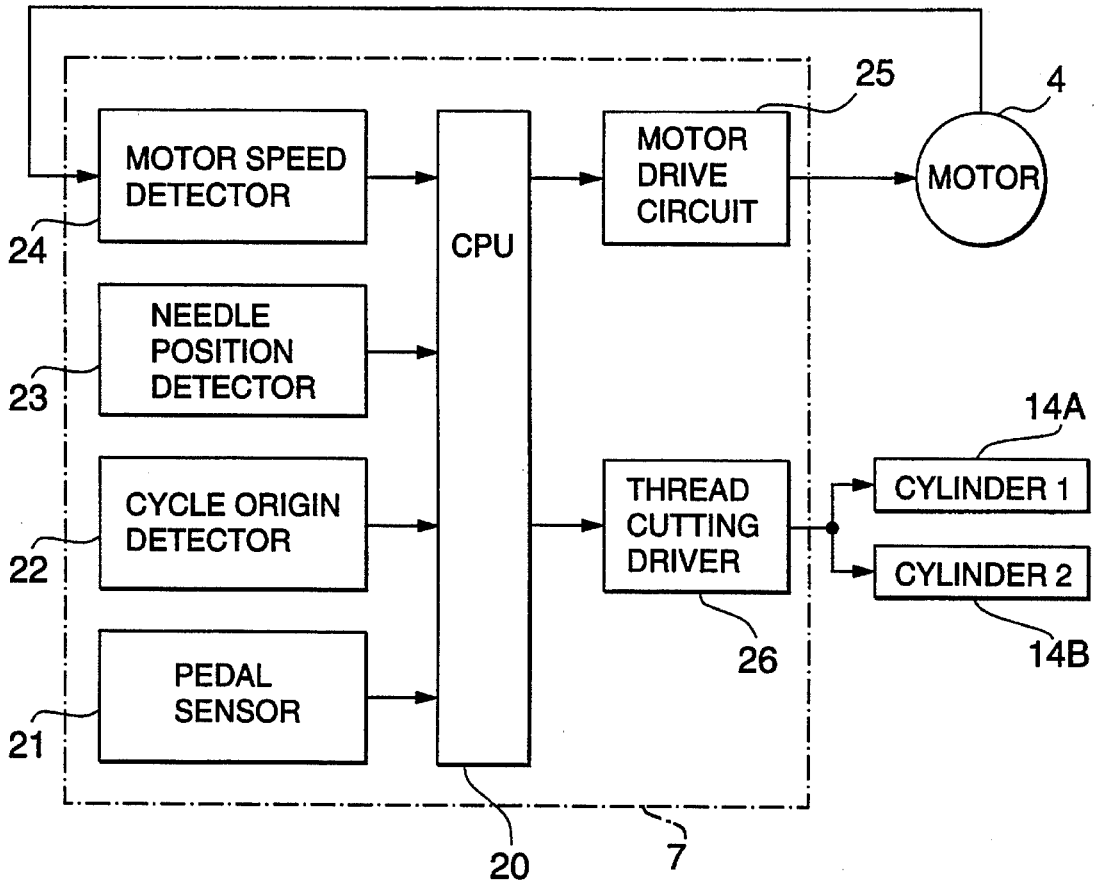
FIG. 13 is a block diagram of a thread cutting mechanism control system employed in a conventional two-needle sewing machine.
Figure 14:
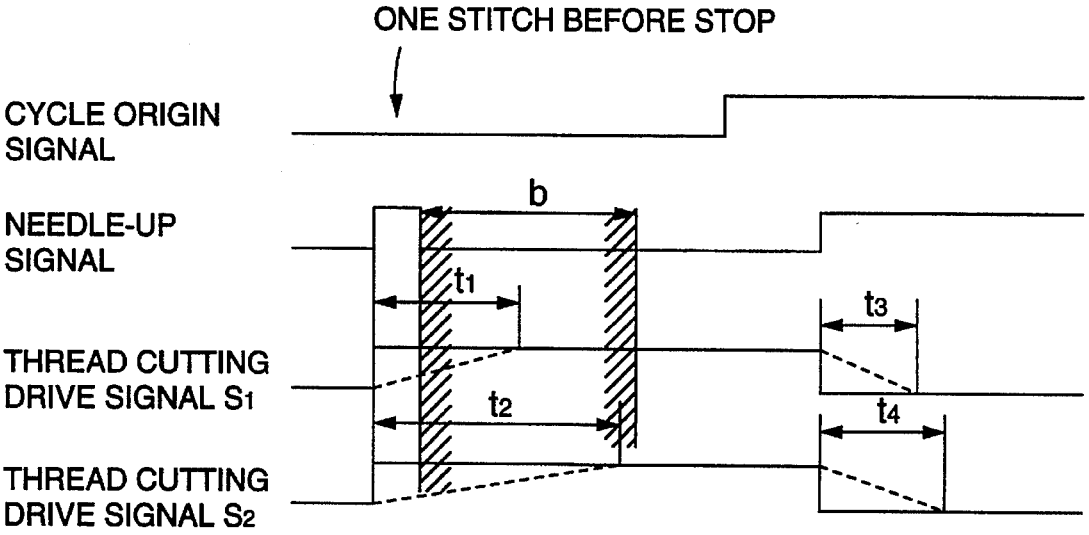
FIG. 14 is a timing chart of a drive timing of a thread cutting mechanism employed in the conventional two-needle sewing machine; and, FIG. 15 is a timing chart of a drive timing of a thread cutting mechanism employed in the conventional two-needle sewing machine.
Figure 15:
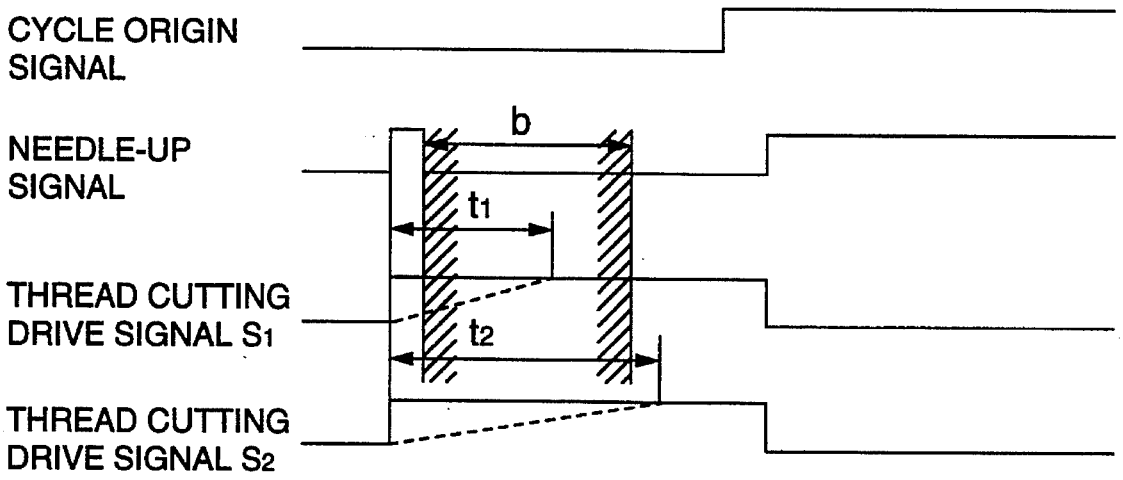

A two-needle sewing machine, which constitutes preferred embodiments of the invention, will be described. In the preferred embodiment, the two-needle sewing machine 1 is similar in arrangement to the one shown in FIG. 11, and thread cutting mechanisms 11A and 11B and actuators (or cylinders 14A and 14B) are similar in arrangement to those shown in FIG. 12.

FIRST EMBODIMENT

A first embodiment of the present invention will be described referring to FIGS. 1 to 5.

Figure 1:
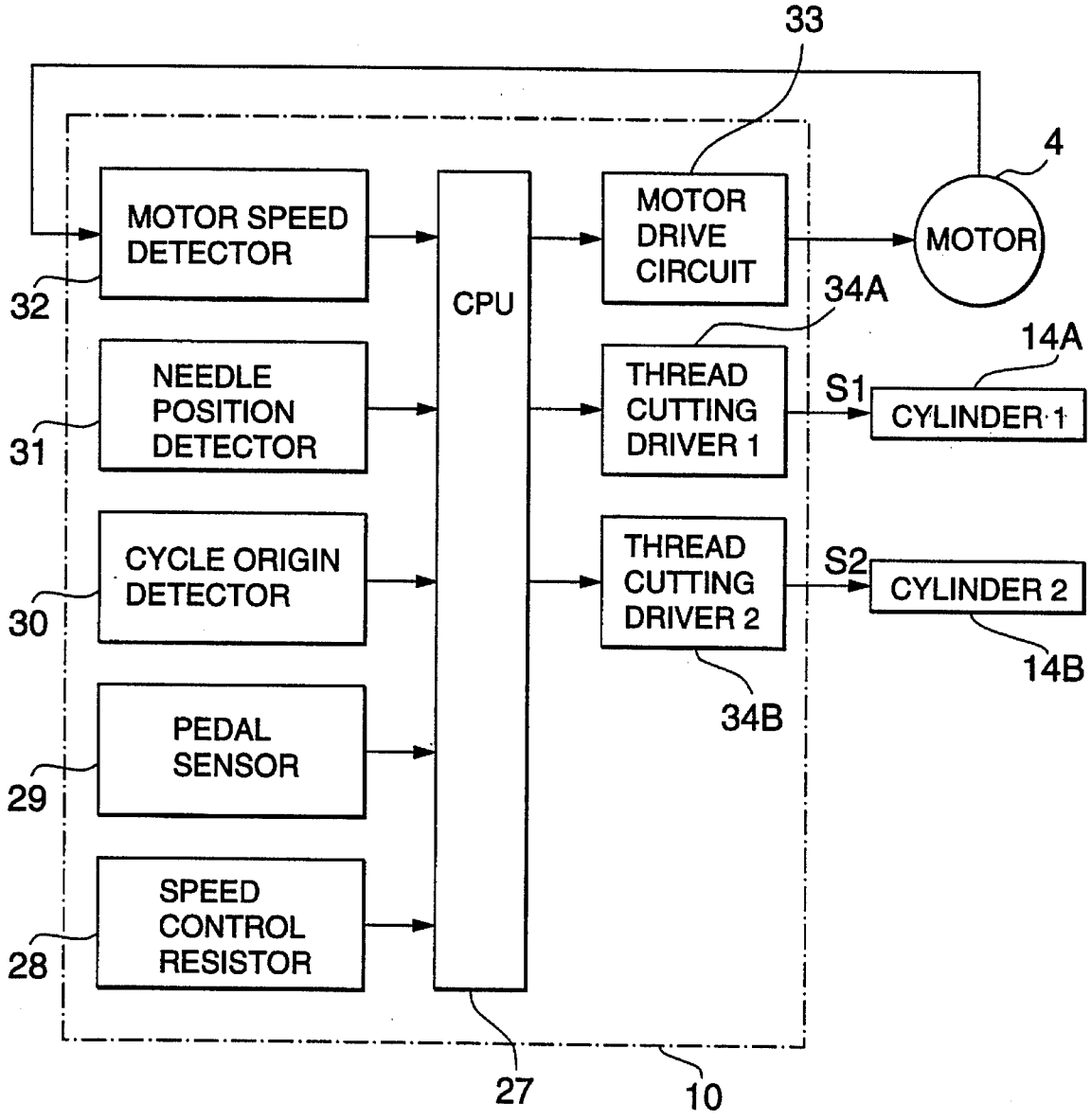
FIG. 1 is a block diagram of an embodiment of a thread cutting mechanism control system employed in a two-needle sewing machine according to the invention.

FIG. 1 is a block diagram for a description of the control of the thread cutting mechanisms in the two-needle sewing machine according to the invention. In FIG. 1, reference numeral 10 designates a thread cutting control circuit provided in the sewing machine control device 5. The thread cutting control circuit 10 includes: a central processing unit (CPU) 27; a speed control resistor 28, a pedal sensor 29, a cycle origin detector 30, a needle position detector 31 and a motor speed detector 32 which are connected to the input section of the CPU 27; and a motor driver circuit 33 and first and second thread cutting driver circuits 34A and 34B which are connected to the output section of the CPU 27.

The CPU 27, incorporating a read-only memory (ROM), a random access memory (RAM) and an input-output device (I/O), applies instruction signals to the motor driver circuit 33 and the thread cutting driver circuits 34A and 34B according to a program stored in the memory in response to detection signals outputted by the speed control resistor 28 and the detectors 29 through 32.

The speed control resistor 28 is mounted on the operating panel of the sewing machine control device 5 so as to freely change the operating speed of the sewing machine 1. When the speed control resistor 28 is operated, its value is read, as a motor rotation instruction speed, by the CPU 27.

The pedal sensor 29 detects the "on" and "off" states of a switch coupled to the pedal 6. The detection signals of the pedal sensor 29 are applied, as sewing machine operating signals, to the CPU 27.

The cycle origin detector 30 is provided at the sewing start origin of a cloth feeding cam forming a cloth feeding mechanism. The cycle origin detector 30 detects the position of the cloth feeding cam, and to output a detection signal (or a cycle origin signal) when the position thus detected is at the cloth feeding start position in the formation of a stitching pattern.

The needle position detector 31 is provided in the sewing machine pulley 8. The detector 31 detects the upward and downward movements of the sewing needles 9A and 9B from the rotation of the pulley 8, and outputs a pulse signal (or a needle up signal) every instance when the sewing needles 9A and 9B are in the highest position.

The motor driver circuit 33 is adapted to output a motor drive signal and a motor stop signal in response to instruction signals from the CPU 27, to drive and stop the motor 4, and to control the speed of rotation of the motor 4.

The first and second thread cutting driver circuits 34A and 34B are to drive the thread cutting mechanisms 11A and 11B provided for sewing needles 9A and 9B, respectively. The first thread cutting driver circuit 34A applies a first thread drive signal S1 to the first thread cutting cylinder 14A in response to a drive instruction signal from the CPU 27; while the second thread cutting driver circuit 34B applies a second thread drive signal S2 to the second thread cutting cylinder 14B in response to a drive instruction signal from the CPU 27.

When, in response to the step-on of the operating pedal 6, the pedal sensor 29 outputs the detection signal, the CPU 27 confirms from the cycle original signal from the cycle origin detector 30 and the needle up signal form the needle position detector 31 that each of the sewing needles 9A and 9B is at the cycle origin of the stitching pattern. The CPU 27 then reads the value of the speed control resistor 28 as a motor rotation instruction speed. According to the value thus read, the CPU 27 applies a motor drive instruction signal to the motor driver circuit 33 to rotate the motor 4. When the motor 4 is rotated in this manner, the rotation of the motor 4 is transmitted through the endless belt to the sewing machine pulley 8, so that the torque of the spindle rotating together with the pulley 8 is transmitted through the cam mechanism to the cloth feeding mechanism and the needle driving mechanism in the sewing machine body. That is, the stitching operation is started. Simultaneously when the stitching operation is started in the above-described manner, a counter circuit in the CPU 27 starts counting the needle up signal which is outputted by the needle position detector 31. Thus, the CPU 27 counts the numbers of stitches from the cycle origins which the sewing needles 9A and 9B have formed, respectively. When the number of stitches thus counted have reached a predetermined value, the CPU 27 applies a motor stop instruction signal to the motor driver circuit 33 to stop the motor 4. In addition, the CPU 27 counts the output pulse of an encoder in the motor speed detector 32 for a period of time which elapses from the time instant that the CPU 27 receives a needle up signal until the CPU 27 receives the next needle up signal, thereby to detect the positions of the sewing needles 9A and 9B (the angle of rotation of the spindle). The CPU 27 controls each of the first and second thread cutting cylinders 14A and 14B according to the number of pulses and the number of stitches from the cycle origin which are counted after reception of the needle up signal and to the motor rotation instruction speed as follows:

In this connection, it is assumed that the number of stitches corresponding to one sewing cycle is thirty (30), and the number of stitches which is detected to apply the motor stop instruction signal to the motor driver circuit 33 is twenty-seven (27).

Figure 2:
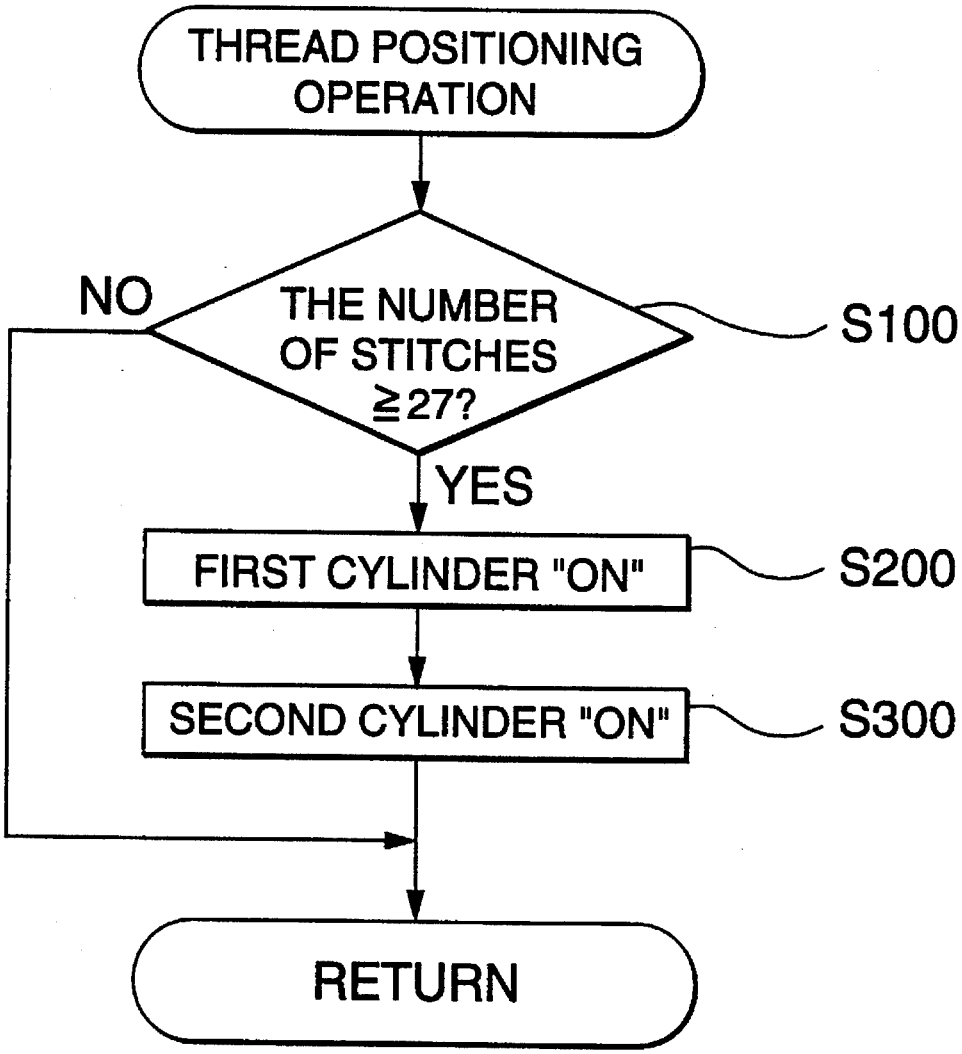
FIG. 2 is a flow chart of an outline of a procedure for driving a thread cutting actuator (cylinder) employed in the control system shown in FIG. 1.

The CPU 27, while applying the motor drive instruction signal to the motor driver circuit 33, periodically calls a thread positioning control routine in a flow chart as shown in FIG. 2. In the routine, first it is determined whether or not the number of stitches counted in the above-described manner is twenty-seven (27) or larger (Step S100). When it is less than twenty-seven, it means that the stitching operation is being performed. When it is twenty-seven (27) or larger, then in order to perform the thread positioning operation before the sewing machine is stopped, the CPU calls a first thread cutting cylinder 1 "on" routine (Step S200) and a second thread cutting cylinder 2 "on" routine (Step S300) in the state order. After the number of stitches is greater than twenty-seven (27), the value of the speed limiting variable resister 28 is not used for the motor rotation instruction speed in order to reduce the speed along a predetermined schedule.

Figure 3:
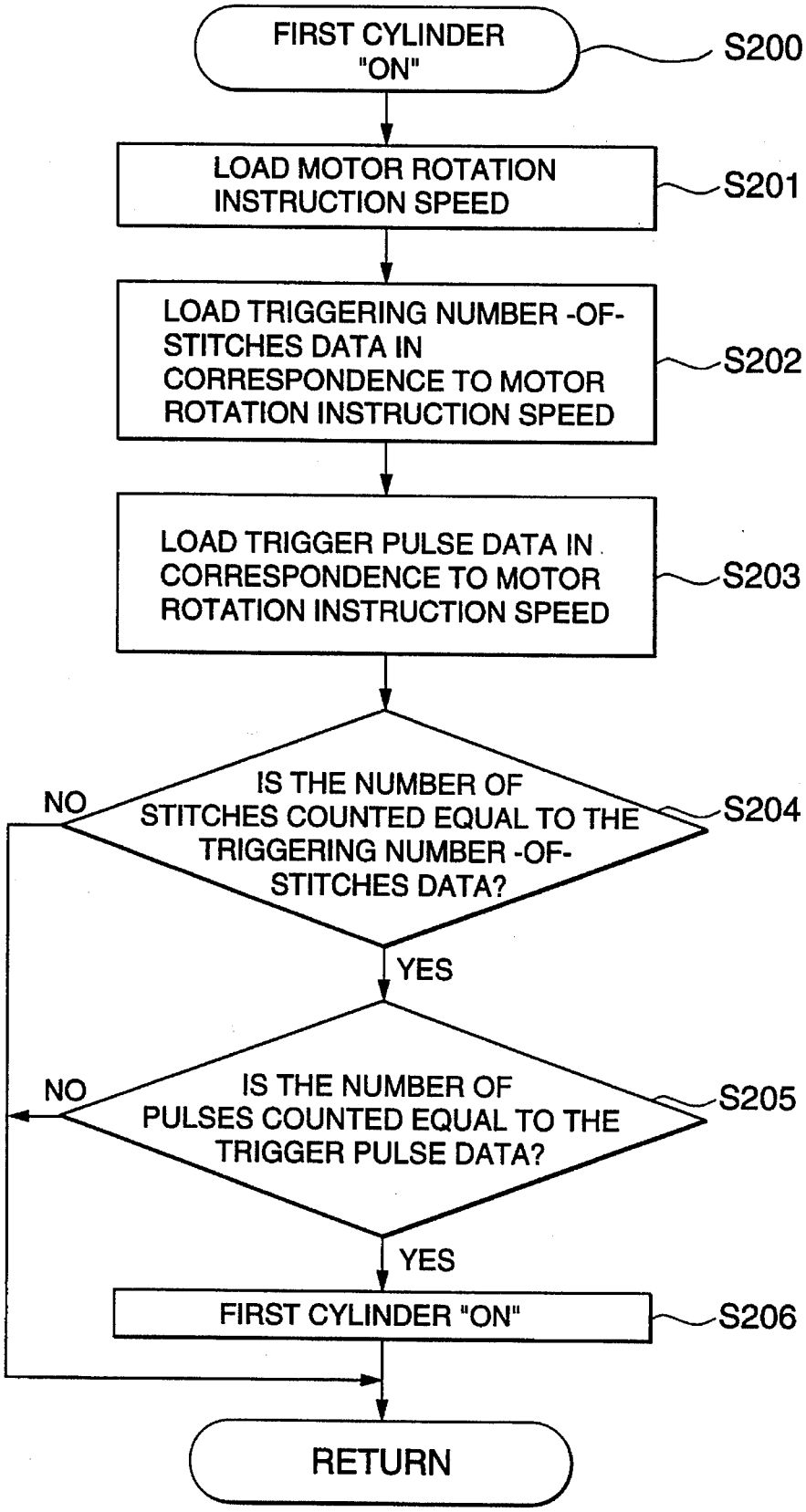
FIG. 3 is a flow chart of the details of a procedure for driving a thread cutting actuator (cylinder) employed in the control system shown in FIG. 1.

In the first thread cutting cylinder 1 "on" routine (Step S200) as shown in FIG. 3, first the motor rotation instruction speed is loaded as the speed of rotation of the motor 4 (Step S201). And, in correspondence to the motor rotation instruction speed, triggering number-of-stitches data (Step S202) and triggering pulse data (Step S202) are loaded successively with reference to the following Table 1:

TABLE 1

| | Thread cutting cylinder 1 | | Thread cutting cylinder 2 | |
|---|---|---|---|---|
| Rotation instruction speed | Triggering number-of-stitches | Triggering pulse data | Trlggering number-of-stitches | Triggering pulse data |
| 2001–2300 | 28 | 330 | 28 | 100 |
| 1701–2000 | 28 | 300 | 28 | 140 |
| . | . | . | . | . |
| . | . | . | . | . |
| . | . | . | . | . |
| 401–700 | 29 | 20 | 28 | 320 |
| 200–400 | 29 | 40 | 28 | 340 |

The triggering pulse data represent the angles of rotation of the spindle as follows: That is, 360 pulses are provided for a period of time between reception of a needle up signal and reception of the next needle up signal, so that the angle of ration of the spindle is indicated with one pulse as one degree. In addition, the triggering pulse data relate to the needle positions as follows: That is, 0 pulse or 360 pulses corresponds to the needle up position, and 180 pulses to the needle down position.

Next, it is determined whether or not the number of stitches counted agrees with the triggering number-of-stitches data (Step S204). Where the number of stitches counted is not in agreement with the triggering number-of-stitches data, it means that it is not to drive the first thread cutting cylinder 14A, and therefore the first thread cutting cylinder 14A is not driven. When the number of stitches counted is in agreement with the triggering number-of-stitches data, it is determined whether or not the number of pulses counted after the reception of the needle up signal is larger than the trigger pulse data (Step S205). When it is determined that the number of pulses counted is larger than the number of trigger pulse data, the thread cutting instruction signal is applied to the thread cutting driver circuit 34 immediately, to drive the first thread cutting cylinder 14A.

In the second thread cutting cylinder 2 "on" routine (Step S300), similarly as in the above-described first thread cutting cylinder 1 "on" routine, in correspondence to a given motor rotation instruction speed, triggering number-of-stitches data and triggering pulse data are loaded successively with reference to Table 1, to drive the second thread cutting cylinder 14B.

As was described above, in the thread cutting control circuit, the timing that the CPU 27 applies the thread cutting drive signal S1 to the first thread cutting cylinder 14A, and the timing that the CPU 27 applies the thread cutting drive signal S2 to the second thread cutting cylinder 14B, are stored as data corresponding the numbers of stitches and the needle positions (the numbers of pulses) which are reached after the start of the stitching operation for every range of speeds (or rotation instruction speeds) of the motor 4. The data thus stored are utilized to obtain the number of stitches and the needle position corresponding to the speed of rotation of the motor for each of the actuators 14A and 14B. When the number of stitches and the numbers of pulses which are counted from the start of the stitching operation agree with the triggering number-of-pulse data and the triggering pulse data which are obtained from the aforementioned data, the thread cutting drive signal (S1 or S2) is applied to the concerned thread cutting cylinder (14A or 14B). Hence, even if the motor rotation instruction speed which is set to various values by the speed control resistor 28 is low as in the case of FIG. 4 or high as in the case of FIG. 5, the first thread cutting cylinder 14A (with the response time t1) and the second thread cutting cylinder 14B (with the response time t2) are finally made to respond with the same timing; that is, the thread positioning operations by the two thread cutting mechanisms 11A and 11B are accurately coincided with each other in timing, so that the thread positioning operations are achieved within the range b.

Figure 4:
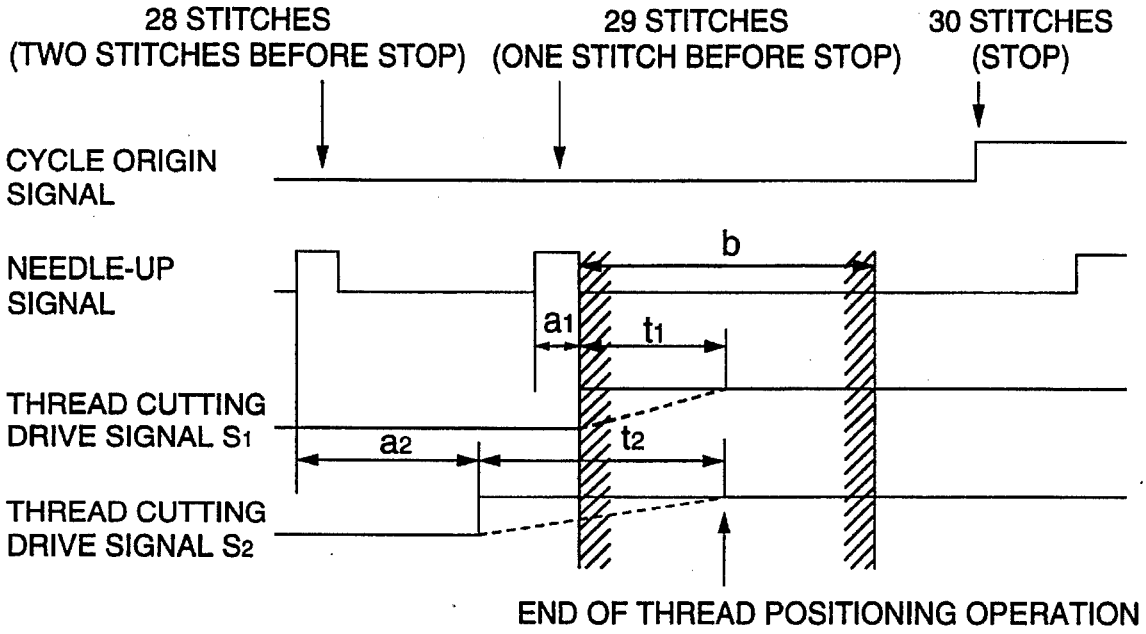
FIG. 4 is a timing chart of a drive timing of a thread cutting mechanism employed in a two-needle sewing machine according to the invention.
Figure 5:
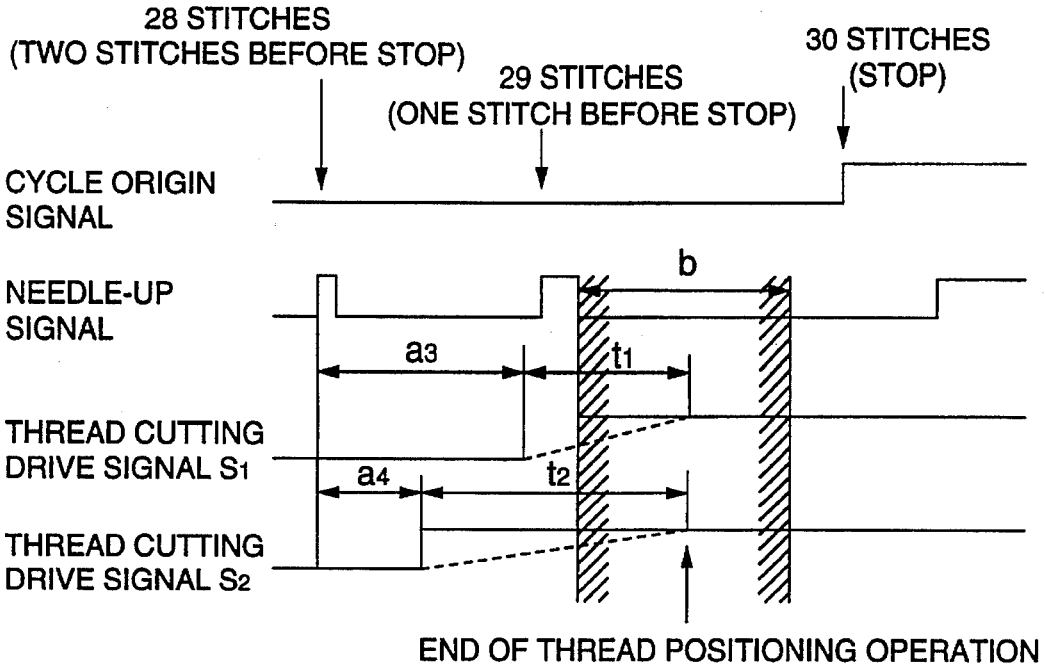
FIG. 5 is a timing chart of a drive timing of a thread cutting mechanism used in a two-needle sewing machine according to the invention.

In the case of FIG. 4, the triggering number-of-stitches data of the first thread cutting cylinder 14A is twenty-nine (29) stitches (one stitch before stop), and the triggering pulse data is a1; and the triggering number-of-stitches data of the second thread cutting cylinder 14B is twenty-eight (28) stitches (two stitches before stop), and the trigger pulse data is a2. In the case of FIG. 5, the triggering number-of-stitches data of the first thread cutting cylinder 14A is twenty-eight (28) stitches (two stitches before stop), and the triggering pulse data is a3; and the triggering number-of-stitches data of the second thread cutting cylinder 14B is twenty-eight (28) stitches (two stitches before the stop), and the triggering pulse data is a4.

SECOND EMBODIMENT

Next, description will be given below of a second embodiment of a two-needle sewing machine according to the invention.

In the second embodiment as well, the control system of the thread cutting mechanism thereof is structured similarly to that shown in FIG. 1.

Figure 6:
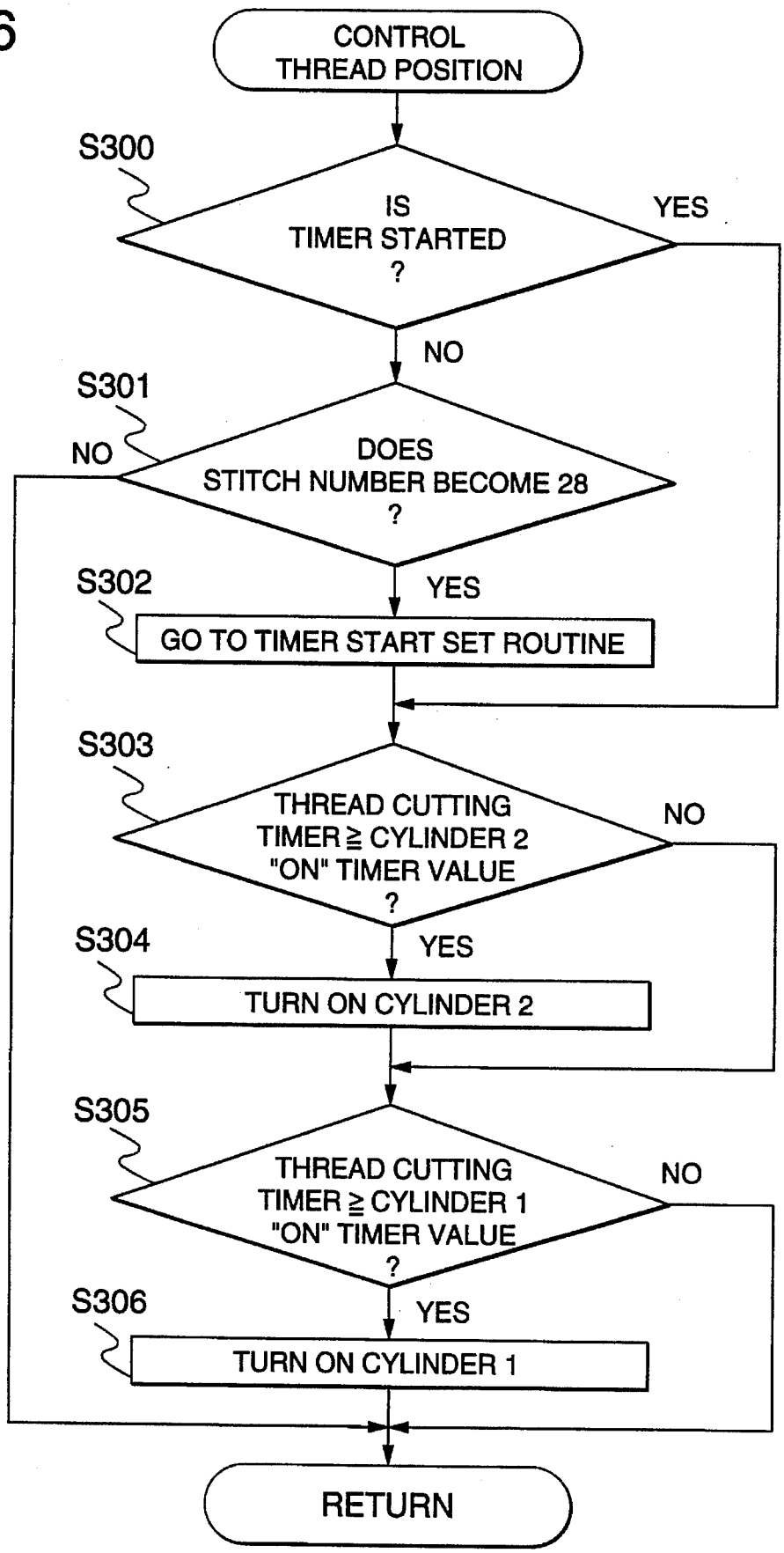
FIG. 6 is a flow chart of part of the processing to be performed by a second embodiment of a two-needle sewing machine according to the embodiment.
Figure 7:
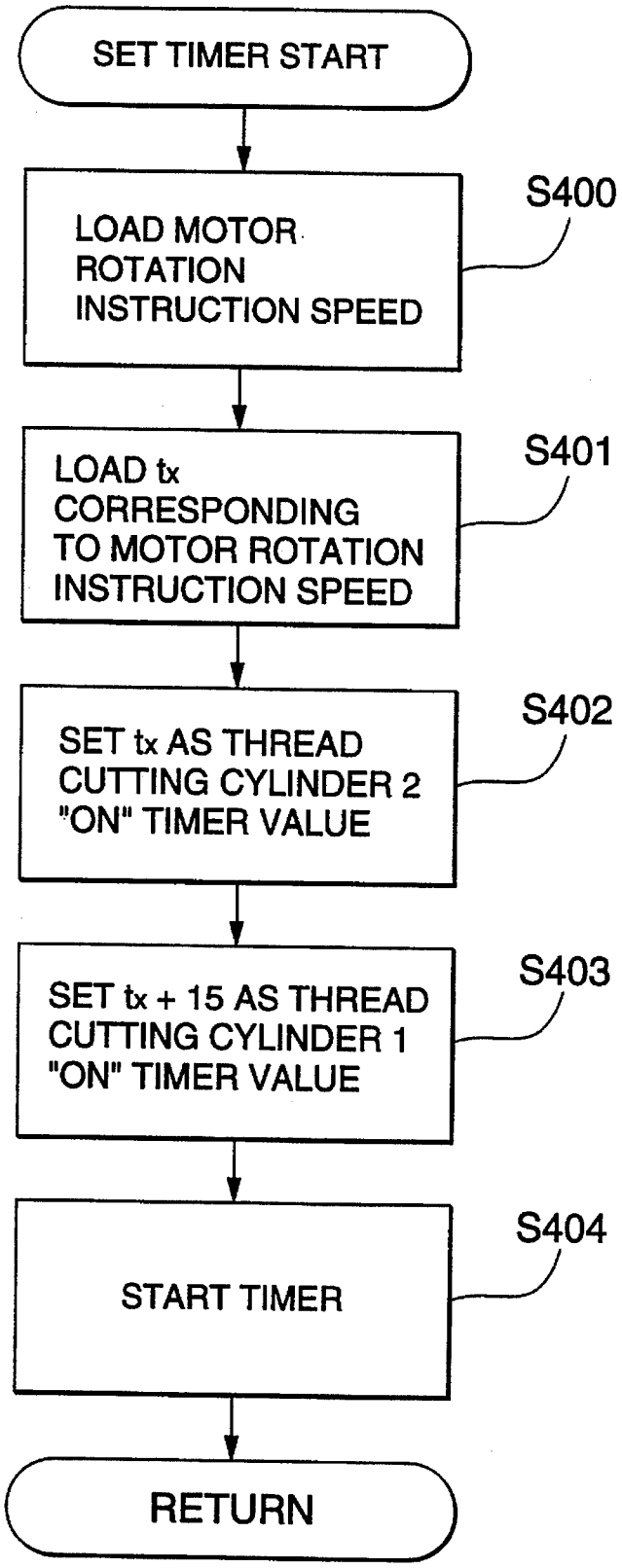
FIG. 7 is a flow chart of part of the processing to be performed by a second embodiment of a two-needle sewing machine according to the embodiment.

The CPU 27, while applying a motor drive instruction signal to the motor drive circuit 33, periodically calls the thread positioning control routine in the flow chart shown in FIG. 6. In the thread positioning control routine, if the number of counted stitches becomes 28, then the timer is started (Step S300). For this purpose, when the timer is not started, it is checked whether the stitch number becomes 28 or not (Step S301), and, if it is found that the stitch number becomes 28, then CPU 27 calls the timer start set routine in the flow chart of FIG. 7 (Step S302).

In the time start set routine, the motor rotation instruction speed or the measured rotation speed is loaded as the rotational speed of the motor 4 (Step S400). And, in accordance with a data table shown in the following Table 2, a time tx corresponding to the motor rotation instruction speed is loaded (Step S401).

TABLE 2

| Rotation Instruction Speed | tx |
|---|---|
| 2001–2300 | 5 |
| 1701–2000 | 10 |
| . | . |
| . | . |
| . | . |
| 401–700 | 45 |
| 200–400 | 50 |

Figure 8:
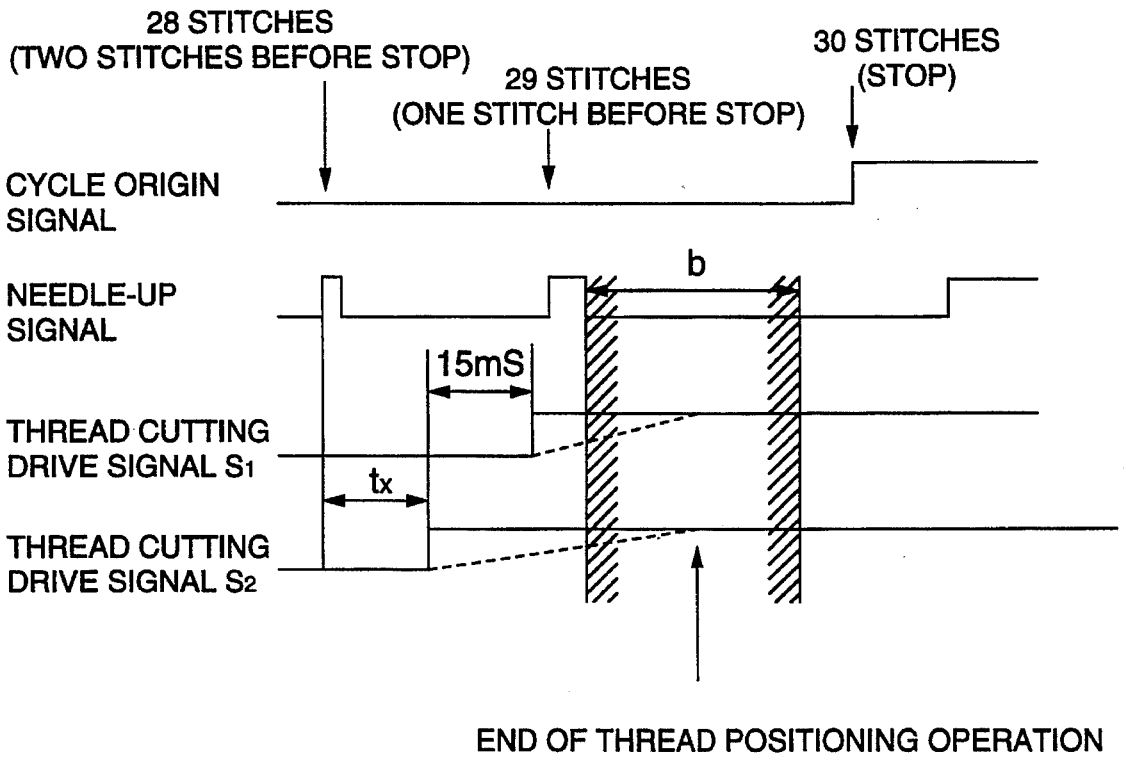
FIG. 8 is a timing chart of a drive timing of a thread cutting mechanism employed in the second embodiment of the invention.

Here, the time tx, as shown in FIG. 8, is the time elapsed after the stitch number has arrived at the reference needle position (in this case, twenty-eight (28) stitches) and serves as a timing to turn on a thread cutting drive signal S2. The time tx can be set for the optimum value for thread positioning according to the motor rotation speeds.

If the time tx is found, then it is stored in the RAM as a thread cutting cylinder 2 "on" timer value (Step S402).

Next, the "on" timing of a thread cutting drive signal S1 is found according to the following equation (1) (Step S403):

$$\textit{Thread cutting cylinder } 1 \text{ "on" timer value} = tx + 15 \quad (1)$$

This is an equation applied when the response time difference between a first thread cutting cylinder 14A and a second thread cutting cylinder 14B is 15 ms. That is, this equation is based on the assumption that, as shown in FIG. 6, if the first thread cutting cylinder 14A is turned on 15 ms after the second thread cutting cylinder 14B is turned on, then the thread positioning completion time of the thread cutting mechanism 11A is coincident with that of the thread cutting mechanism 11B. Even if the greatest number of revolutions of the motor 4 is changed, the same relationship can be always obtained, provided that the deceleration curve remains constant each time it is changed.

After the "on" timings of the first and second thread cutting cylinders 14A and 14B are obtained in this manner, the timer is started (Step S404).

At a time when the timer value is equal to the time tx, the thread cutting drive signal S2 for the second thread cutting cylinder 14B is generated to thereby drive the second thread cutting cylinder 14B (Steps S303, S304). Next, when the timer value is equal to the time tx+15, the thread cutting drive signal S1 for the first thread cutting cylinder 14A is generated to thereby drive the first thread cutting cylinder 14A (Steps S305, S306).

As described above, the CPU 27 applies the thread cutting drive signal S2 to the second thread cutting cylinder 14B at the timing (tx) based on the previously stored data and the rotational speed of the motor 4 or the sewing machine and applies the thread cutting drive signal S1 to the first thread cutting cylinder 14A at the timing (tx+15) calculated according to the response difference between the first and second thread cutting cylinders 14A and 14B. Even when the motor rotation instruction speed, to be set for various values by the speed control knob 28, is set at a low speed as shown in FIG. 4 or at a high speed as shown in FIG. 8, the first thread cutting cylinder 14A (which has a response time t1) and the second thread cutting cylinder 14B (which has a response time t2), which differ in response characteristics from each other can finally respond with the same timing. Therefore the thread positioning timings of the two thread cutting mechanisms 11A and 11B coincide with each other accurately, so that the two thread cutting mechanisms 11A and 11B are able to complete their respective thread positioning operations within the range b.

In this case, since only the data on the driving timing of the second thread cutting cylinder 14B having a faster "on" response time is previously stored in the thread cutting control circuit 10 and the driving timing of the first thread cutting cylinder 14A having a slower "on" response time can be found by the above operation, the quantities of the data to be stored in the memory of CPU 27 are reduced in comparison with the previously described first embodiment.

THIRD EMBODIMENT

Next, description will be given below of a third embodiment of a two-needle sewing machine according to the invention.

Figure 9:
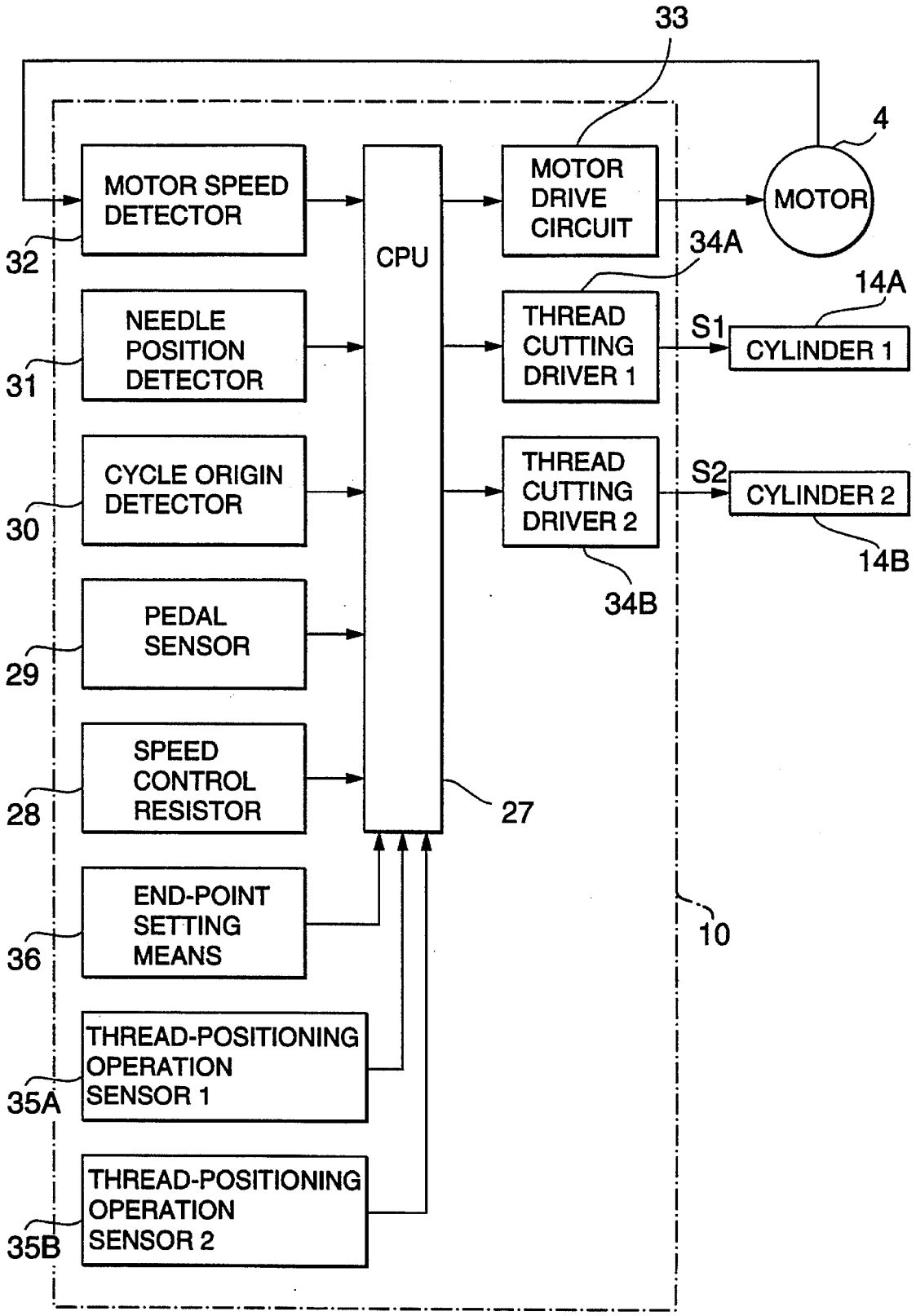
FIG. 9 is a block diagram of a thread cutting mechanism control system employed in a third embodiment of a two-needle sewing machine according to the invention.

FIG. 9 is a block diagram of a control system of the third embodiment of a two-needle sewing machine according to the invention.

According to the present control system, in the structure of the second embodiment of the invention, in the respective thread cutting mechanisms 11A and 11B, there are provided sensors 35A and 35B which are respectively used to detect the times when their respective thread positioning operations are completed.

Also, the present control system can detect the needle position in encoder pulses such that it counts the encoder pulse signal of a motor speed detector 32 with the pulse signal of a sewing machine needle position detector 31 as a reference. Further, the control system includes a thread positioning completion point setting means 36 to set the optimum points for the thread positioning operation completion of the respective thread cutting mechanisms 11A and 11B in encoder pulses.

Figure 10:
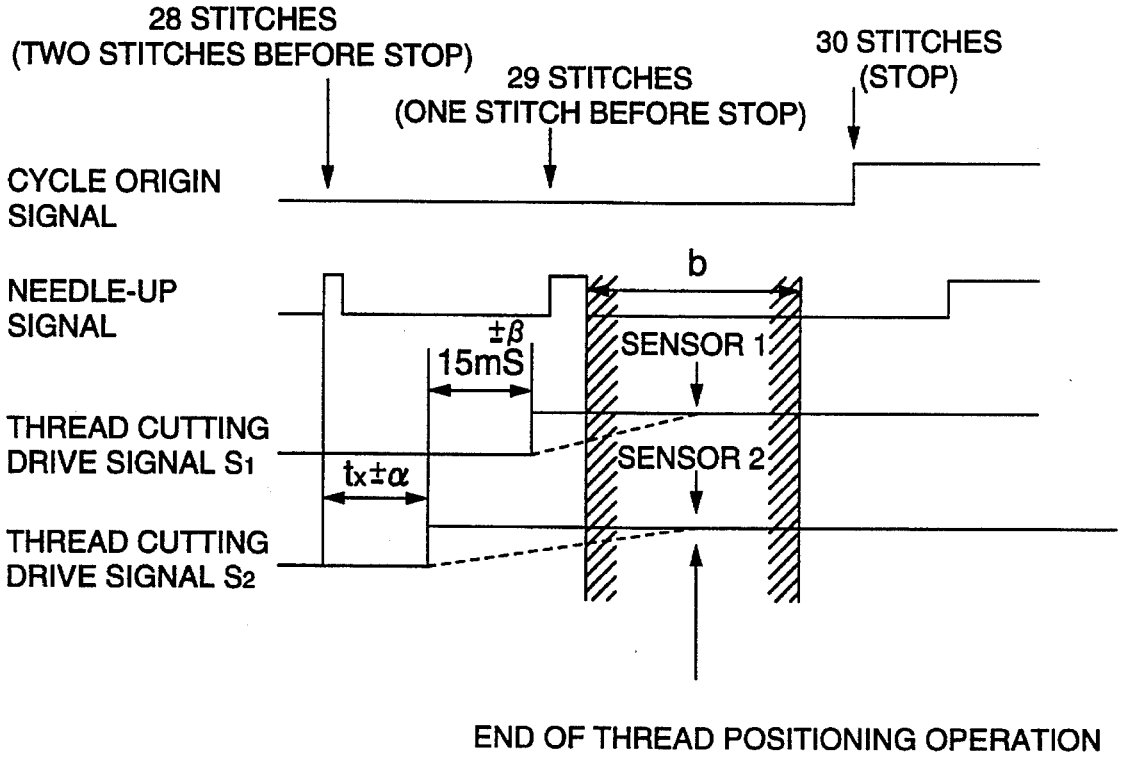
FIG. 10 is a timing chart of a drive timing of a thread cutting mechanism employed in the third embodiment of the invention.

The thread positioning completion point setting means 36 includes a pair of adjusting knobs which are provided on the operation panel of the sewing machine control device 5 for adjusting the "on" timings of the first and second thread cutting cylinders 14A and 14B. That is, by operating the respective adjusting knobs, an instruction can be given to the CPU 27, so that the "on" timings of the first and second thread cutting cylinders 14A and 14B can be shortened or extended, as shown in FIG. 10. In FIG. 10, $\pm\beta$ represents the amount of correction of the "on" timing of the first thread cutting cylinder 14A, while $\pm\alpha$ points out the amount of correction of the "on" timing of the second thread cutting cylinder 14B.

In the third embodiment, the CPU 27 is programmed such that it allows the thread positioning sensors 35A and 35B to detect the thread positioning operation completion points of the two thread cutting mechanisms 11A and 11B respectively. The CPU 27 also checks whether the encoder pulse values at the detected points are coincident with the encoder pulse values at the optimum thread positioning completion points set by the thread positioning completion point setting means 36 or not. The CPU 27 further applies drive instruction signals to first and second thread cutting driver circuits 34A and 34B so that the thread positioning timings of the thread cutting mechanisms 11A and 11B can be made to coincide with the optimum points set by the setting means 36 in the next cycle operation.

Therefore, according to the structure of the third embodiment, even when the response characteristics of the first and second thread cutting cylinders 14A and 14B are changed because the air pressures thereof are varied, or even when the thread cutting load is varied excessively according to the characteristics of threads used or objects to be sewn and the thread cutting drive time is thereby caused to vary, the "on" timings of the first and second thread cutting cylinders 14A and 14B can be respectively corrected to the optimum timings by the thread positioning completion point setting means 36, so that the thread can be always cut stably.

As has been described heretofore, according to the two-needle sewing machine of the present embodiments, even when the two thread cutting cylinders 14A and 14B differing in the response time from each other are required from the viewpoint of the mechanical space of the sewing machine body 3, or even when two cylinders equivalent in performance are used but the response times thereof are different from each other by the difference between the mechanical loads of the thread cutting mechanisms 11A and 11B, it is not necessary to lower the operating speed of the sewing machine to thereby wait for the response of the thread cutting cylinder 14B having a lower response time, which can shorten the cycle time necessary to execute the same pattern stitching operation repeatedly, so that the stitching efficiency is greatly improved. Also, even if the rotational speed of the motor 4 is set for various values, the two thread cutting mechanisms 11A and 11B can be always driven and controlled at the same thread positioning timing to thereby be able to stabilize the thread cutting quality.

However, the two-needle sewing machine according to the invention is not limited to the above embodiment. For example, even when a drive mechanism such as an electric motor or the like is used as an actuator for driving the thread cutting mechanisms 11A and 11B, in consideration of the characteristics of the actuator, the timing to apply the thread cutting drive signal may be previously stored in the thread cutting control circuit as the data corresponding to the number of revolutions of the sewing machine driving motor 4. That is, the data on the timings of the thread cutting drive signals shown in the above embodiment are only examples and the timings can be set for various proper values in consideration of the response characteristics of the actuator, the mechanical loads of the thread cutting mechanisms and the like.

As has been described heretofore, according to the invention, there can be provided the following excellent effects:

(1) Due to provision of the thread cutting control circuit which applies the thread cutting drive signals to the two actuators at different timings in accordance with the previously stored data or the rotational speeds of the motor or the sewing machine, even when two actuators differ in response time, the sewing machine is operated without being restricted by the response time of the actuator having a slower response time, thereby being able to improve the sewing efficiency thereof to a great extent. Also, since the two thread cutting mechanisms can be driven at the same timing, the thread cutting operation can be always performed stably.

(2) Due to provision of a thread cutting control circuit which applies the thread cutting drive signal to one actuator at a timing based on the previously stored data or the rotational speeds of the motor or the sewing machine and applies the thread cutting drive signal to the other actuator at a timing which can be found by means of calculation according to the response difference between the two actuators, even when two actuators are used differing in the response characteristics from each other, the sewing machine can be operated without being restricted by the response time of the actuator having a slower response time, thereby being able to improve the sewing efficiency thereof to a great extent. Also, since the two thread cutting mechanisms can be driven with the same timing, the thread cutting operation can always be performed stably.

The two-needle sewing machine of the invention, being designed as described above, is advantageous in the following points: In the case where, because of the mechanical space of the sewing machine body 3, thread cutting cylinders (14A and 14B) different in response time must be employed, or in the case where, although the thread cutting cylinders are equal in performance, they are made different in response time for instance because of the difference in mechanical loads between the thread cutting mechanisms 11A and 11B, it is unnecessary to wait for the operation of the thread cutting cylinder 14B which is slower in response, by decreasing the operating speed of the sewing machine. Hence, in repeatedly performing a stitching operation of one and the same pattern with the two-needle sewing machine of the invention, the cycle time can be shortened; that is, the stitching operation is markedly improved in work efficiency. In addition, even if the speed of rotation of the motor 4 is set to various values, the two thread cutting mechanisms 11A and 11B can achieve the thread positioning operations with the same timing at all times, and therefore the thread cutting operations are also with high stability.

The two-needle sewing machine of the invention is not limited only to that which has been described above. For instance, it may be so modified that driving mechanisms such as electric motors are employed as the actuators for driving the thread cutting mechanisms. In this case, the timing of application of the thread cutting drive signals is stored, as data corresponding to the speeds (rpm) of the sewing machine driving motor 4, in the thread cutting control circuit in advance. Hence, the above-described data concerning the timing of application of the thread cutting drive signals are nothing but examples, and they can be set to other values with the response characteristics of the actuators and the mechanical loads of the thread cutting mechanisms taken into account.

As was described above, the two-needle sewing machine of the invention comprises the thread cutting control circuit which applies the thread cutting drive signals to the first and second actuators at different time instants according to the data stored and the speed of rotation of the motor. Hence, even when the actuators are different in response characteristics, the sewing machine is not limited by the response time of the actuator having a slower response. This feature markedly improves the sewing efficiency. In addition, since the two thread cutting mechanisms can be driven with the same timing, the thread cutting operation is stable at all times.

What is claimed is:

1. A two-needle sewing machine comprising:

first and second sewing needles for performing two stitching operations at the same time;

a motor for driving said first and second sewing needles;

first and second thread cutting mechanisms provided for said first and second sewing needles, respectively, for cutting threads at the ends of said stitching operations;

a first actuator and a second actuator for driving respective ones of said first and second thread cutting mechanisms; and a thread cutting control circuit which stores data corresponding to the timing of a first thread cutting drive signal to said first actuator and the timing of a second thread cutting drive signal to said second actuator, both signals corresponding to rotational speeds of said motor, and which, according to said data and the rotational speeds of said motor, applies the first and second thread cutting drive signals to said first and second actuators at different times defined by said data.

2. A two-needle sewing machine according to claim 1, wherein said thread cutting control circuit comprises:

a speed detector for detecting the rotational speed of said motor;

a needle position detector for detecting first and second needle positions;

a stitching counter for counting a number of stitches;

memory means for storing said data; and control means for reading said data corresponding to the rotational speed from memory means, and, after the number of stitches reaches a number defined by said data as read, for providing the first thread cutting drive signal to said first actuator when the first needle position comes to a position defined by said data as read, and providing the second thread cutting drive signal to said second actuator when the second needle position comes to a position defined by said data as read.

3. A two-needle sewing machine according to claim 1, wherein each of said first and second thread cutting mechanisms comprises:

a base member;

a stationary knife fixedly mounted on said base member; and a movable knife rotatable by said respective actuator.

4. A two-needle sewing machine according to claim 1, further comprising:

a motor driver for varying the rotational speed of said motor.

5. A two-needle sewing machine comprising:

first and second sewing needles for performing two stitching operations at the same time;

a motor for driving said first and second sewing needles;

first and second thread cutting mechanisms provided for said first and second sewing needles, respectively, for cutting threads at the ends of said stitching operations;

a first actuator and a second actuator for driving respective ones of said first and second thread cutting mechanisms; and a thread cutting control circuit for storing therein, as data corresponding to a rotational speed of said motor, a time at which a thread cutting drive signal is applied to said first actuator and another time at which another thread cutting drive signal is applied to said second actuator, said thread cutting control circuit applying a drive signal at different times to said first and second actuators according to said data and said rotational speed.

6. A two-needle sewing machine according to claim 5, wherein said thread cutting control circuit comprises:

a speed detector for detecting the rotational speed of said motor;

a needle position detector for detecting first and second needle positions;

a stitching counter for counting a number of stitches;

memory means for storing said data; and control means for reading said data corresponding to the rotational speed from memory means and providing not only said thread cutting drive signal applied to said first actuator when said first needle is brought to a position defined by said data as read but also said thread cutting drive signal applied to said second actuator when said second needle is brought to another position defined by said data as read upon forming a number of stitches, as defined by said data which has been read.

7. A two-needle sewing machine according to claim 5, wherein each of said first and second thread cutting mechanisms comprises:

a base member;

a stationary knife fixedly mounted on said base member; and a movable knife rotatable by said respective actuator.

8. A two-needle sewing machine according to claim 5, further comprising:

a motor driver for varying the rotational speed of said motor.

9. A two-needle sewing machine comprising:

first and second sewing needles performing two stitching operations at the same time;

a motor for driving said first and second sewing needles;

first and second thread cutting mechanisms provided for said first and second sewing needles, respectively, for cutting threads at the ends of said stitching operations;

a first actuator and a second actuator for driving respective ones of said first and second thread cutting mechanisms; and a thread cutting control circuit for storing therein timing data corresponding to application of thread cutting drive signals to said first and second actuators, said data further corresponding to the rotational speeds of said motor, for determining a time of application of said thread cutting drive signal to said first actuator in accordance with said stored data, for determining a time of application of said thread cutting drive signal to said second actuator according to a response difference between said first and second actuators, and for applying said thread cutting drive signals to said first and second actuators at their respective times.

* * * * *